US007661154B2

(12) United States Patent
Cheng

(10) Patent No.: US 7,661,154 B2
(45) Date of Patent: Feb. 16, 2010

(54) BATHING CHAIR WITH TURNABLE SEAT

(76) Inventor: Yu-Wen Cheng, 6F, NO. 137-4, Da-Shen Street, Taichung City (TW)

( * ) Notice: Subject to any disclaimer, the term of this patent is extended or adjusted under 35 U.S.C. 154(b) by 377 days.

(21) Appl. No.: 11/881,295

(22) Filed: Jul. 26, 2007

(65) Prior Publication Data

US 2009/0025136 A1 Jan. 29, 2009

(51) Int. Cl.
*A47K 3/02* (2006.01)

(52) U.S. Cl. ..... 4/560.1; 4/578.1; 4/562.1

(58) Field of Classification Search ..... 4/560.1, 4/562.1, 563.1, 278.1, 559, 579
See application file for complete search history.

(56) References Cited

U.S. PATENT DOCUMENTS 4,097,016 A * 6/1978 Petrucci ..... 248/418
4,518,139 A * 5/1985 Barfell ..... 248/418
5,097,542 A * 3/1992 Roesler ..... 4/579
5,822,809 A * 10/1998 Gallo ..... 4/578.1
6,164,722 A * 12/2000 Mabey ..... 297/344.22
6,169,630 B1 * 1/2001 Shirasaki et al. ..... 359/577
6,240,577 B1 * 6/2001 Worthy ..... 4/578.1
6,536,842 B2 * 3/2003 Bowers et al. ..... 297/344.22
6,681,415 B1 * 1/2004 Gallo ..... 4/560.1

* cited by examiner

*Primary Examiner*—Khoa D Huynh
(74) *Attorney, Agent, or Firm*—Pro-Techtor Int'l Services; Ralph Willgohs

(57) ABSTRACT

A bathing chair with a fixing device comprises a front frame and a rear frame, shaped like the inverted letter U, reaching across a bathtub and having horizontal rods which pass over an edge of the bathtub at a distance, the front and rear frames being connected by right and left connecting rods, a seat, having a fixed base mounted on the horizontal rods, an axis mounted on the fixed base in a central position thereof, and a rotatable base, which is rotatable around the axis, a bearing assembly, comprising several gliding blocks connected with the seat and allowing the seat to glide along the horizontal rods, and a handle.

3 Claims, 7 Drawing Sheets

BATHING CHAIR WITH TURNABLE SEAT

FIELD OF THE INVENTION

The present invention relates to a bathing chair, particularly to a bathing chair with a turnable seat for easy seating of a user.

BACKGROUND OF THE INVENTION

As shown in FIGS. 8 and 9, a bathing chair for assisting elderly and handicapped persons to enter and leave a bathtub has been disclosed in U.S. Pat. No. 5,940,905, "bathing chair positioning system". The bathing chair taught therein comprises a front frame 21; a rear frame 22; a bearing assembly 3; a seat 4; a handle 5; and fixing devices 6, 6A. The front and rear frame rods 21, 22 are shaped like the inverted letter U, reaching across a bathtub 1 and have horizontal rods 211, 221 which pass over an edge 11 of the bathtub 1 at a distance. A right connecting rod 23A and a left connecting rod 23B connect the front and rear frame rods 21, 22. The seat 4 is a plate of roughly rectangular shape and is mounted on the horizontal rods 211, 221, being movable along the horizontal rods 211, 221. The bearing assembly 3 comprises several gliding blocks which are connected with the seat 4 on a lower side thereof, keeping a distance thereto, and glide along the horizontal rods 211, 221. A backrest 41 is connected to the seat 4 by two L-shaped link rods 42A, 42B. The link rods 42A, 42B constitute an upper seat frame and have horizontal extensions 421A, 421B, which are fastened to the gliding blocks of the bearing assembly 3. Thereby, the seat 4 is enabled to glide along the horizontal rods 211, 221. The handle 5 is a rod which is shaped like the inverted letter U and is fastened to the front and rear frame rods 21, 22 at left ends thereof, reaching higher than the seat 4 for providing a hold when the seat 4 is moved along the horizontal rods 211, 221. The fixing devices 6, 6A are made of plastics or another suitable soft material and are shaped like strips. The fixing devices 6, 6A have fixed ends 61, 61A and holding ends 66, 66A. The fixed ends 61, 61A are fastened to the link rods 42A, 42B of the seat 4, respectively. The holding ends 66, 66A are held on the right and left connecting rods 23A, as needed. At the holding ends 66, 66A, the fixing devices 6, 6A have endpieces 68, 68A from lower sides of which holding elements 67, 67A extend away, respectively. Fastening elements 63, 63A are attached to endpieces 62, 62A at the fixed ends 61, 61A and are in turn fastened to the link rods 42A, 42B to prevent shifting of the fixing devices 6, 6A. Before sitting down on the seat 4, a user pulls up the holding end 66, so that the holding element 67 is held on the right connecting rod 23A. For bathing, the user releases the holding element 67, which subsequently becomes detached from the right connecting rod 23A. The seat 4 is shifted leftward until a leftmost position over the bathtub 1, with the holding element 67A being held on the left connecting rod 23B.

A conventional bathing chair assists elderly and handicapped people to enter and leave a bathtub safely and conveniently. However, turning of the seat 4 is not possible, so that sitting down and getting up from the seat 4 is not convenient.

SUMMARY OF THE INVENTION

It is the object of the present invention to provide a bathing chair with a turnable seat for convenient sitting down and getting up.

For achieving above object, the present invention comprises a front frame and a rear frame, shaped like the inverted letter U, reaching across a bathtub and having horizontal rods which pass over an edge of the bathtub at a distance, the front and rear frames being connected by right and left connecting rods, a seat, having a fixed base mounted on the horizontal rods, an axis mounted on the fixed base in a central position thereof, and a rotatable base, which is rotatable around the axis, a bearing assembly, comprising several gliding blocks connected with the seat and allowing the seat to glide along the horizontal rods, and a handle.

Other aspects and advantages of the present invention will become apparent from the following detailed description, taken in conjunction with the accompanying drawings, illustrating by way of example the principles of the present invention.

DESCRIPTION OF THE PREFERRED EMBODIMENTS

Figure 8:
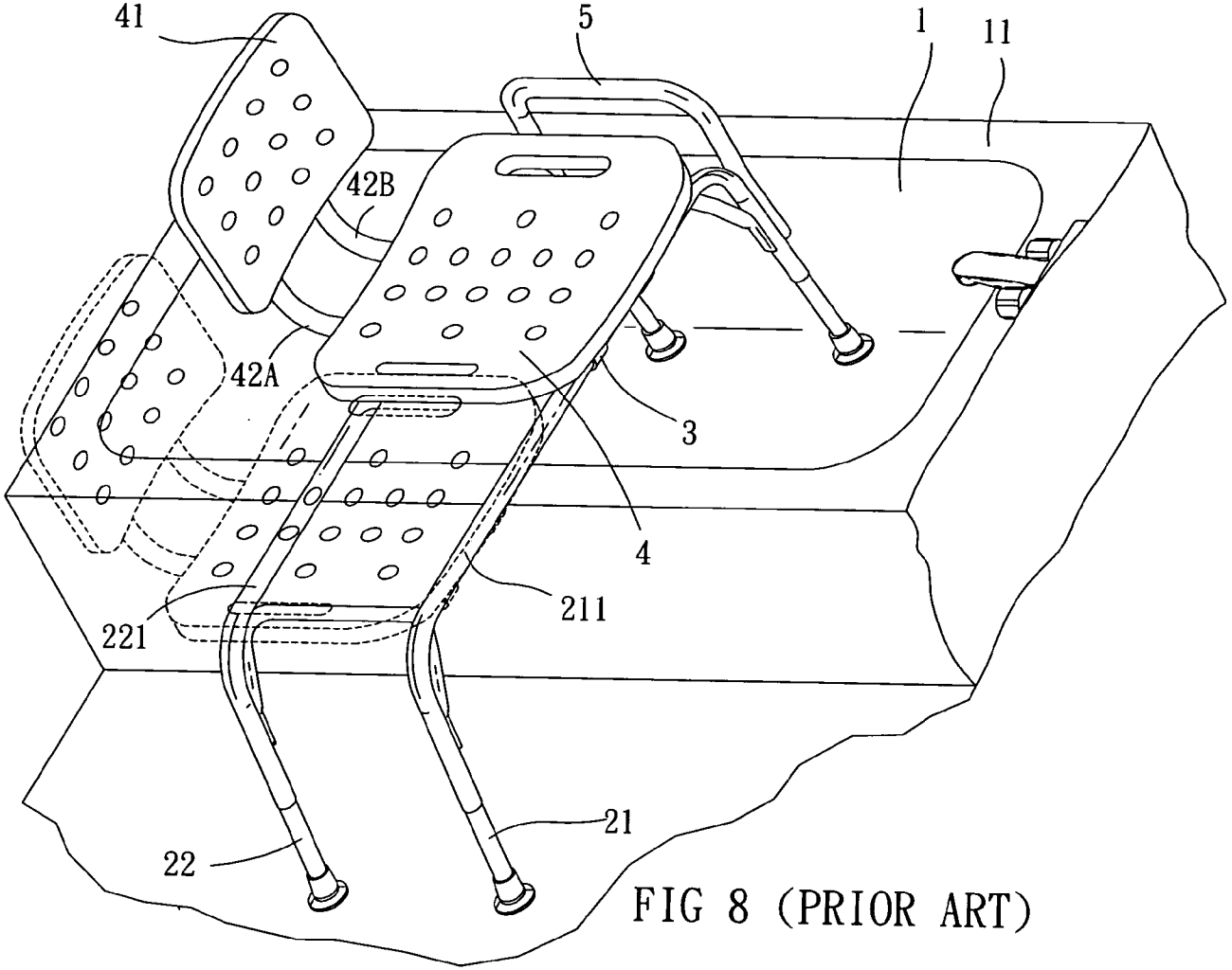
FIG 8 (PRIOR ART)
FIG. 8 (prior art) is a perspective view of a conventional bathing chair.
Figure 9:
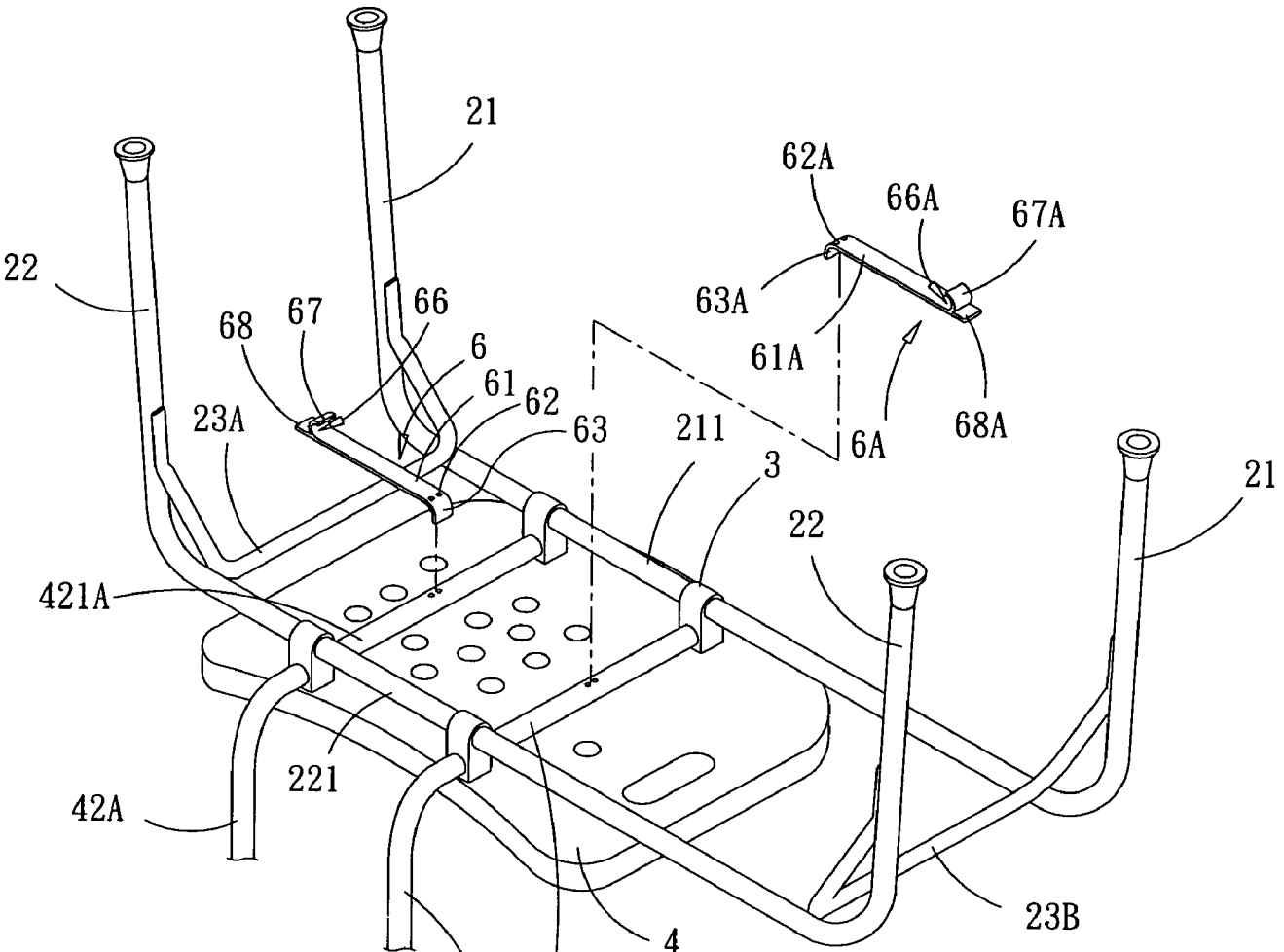
FIG 9 (PRIOR ART)
FIG. 9 (prior art) is an exploded perspective view of a conventional bathing chair.

As shown in FIGS. 1-4B, the bathing chair with a turnable seat of the present invention has a structure which is about the same as the conventional bathing chair shown in FIGS. 8 and 9, with structural parts being denoted by the same numbers. The bathing chair of the present invention further comprises a fixed base 80 with an upper side; an axis 81; and a rotatable base 82 with an upper side. The seat 4 is fastened to the rotatable base 82 and thereby rotatable. Furthermore, by having the bearing assembly 3 glide along the front and rear frame rods 21, 22, convenient sitting down as well as entering and leaving of the bathtub 1 is ensured. In the following, a detailed description is given.

The axis 81 is vertically oriented and placed in the center of the fixed base 80, serving as a rotational axis for turning the rotatable base 82 on the fixed base 80.

The rotatable base 82 is set on the upper side of the fixed base 80 and has at a central position thereof a mounting hole 84, through which the axis 81 passes, and further has two mounting grooves 86, accommodating the link rods 42A, 42B of the seat 4.

For easy rotating of the rotatable base 82, a turning device 85 is mounted on the fixed base 80, having a carrier plate 851. The carrier plate 851 is formed like a disc, having a central hole 853, which is put over the axis 81. The carrier plate 851 further has several openings 855 with inner walls 857, in which rolls 852 are inserted for reducing friction, when the turning device 85 rotates on the fixed base 80.

For fixing the rotatable base 82, when a user sits down on or leaves the seat 4, the rotatable base 82 has a depression 88, accommodating a holding device 90. The holding device 90 comprises several positioning holes 91 in blocking angular positions on the fixed base 80; a fixing hole 92 on the rotatable base 82; a lever plate 93 and a pressing plate 94. The lever plate 93 has a holding end 95, with a transverse projection which, in a blocking state, is inserted into the fixing hole 92, and an outer end 99, which reaches outward beyond and edge of the rotatable base 82. The lever plate 93 has a central lever point 97, around which the holding end 95 and the outer end 99 turn. The pressing plate 94 is mounted on the rotatable base 82 on the upper side thereof by screws 945. An elastic element 941 is inserted between the lever plate 93 and the pressing plate 94, pressing down the holding end 95 of the lever plate 93, so that in the blocking angular positions, when the fixing hole 92 is aligned with one of the positioning holes 91, the blocking state is assumed, with the projection 96 entering the fixing hole 92 and one of the positioning holes 91.

Figure 4A:
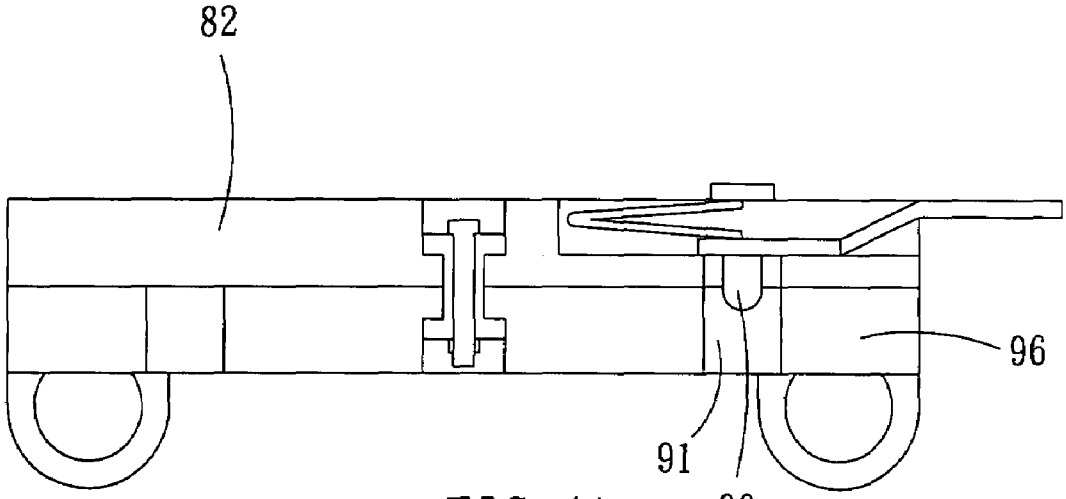
FIGS. 4A-4B are schematic illustrations of the movement of the holding device of the present invention.
Figure 4B:
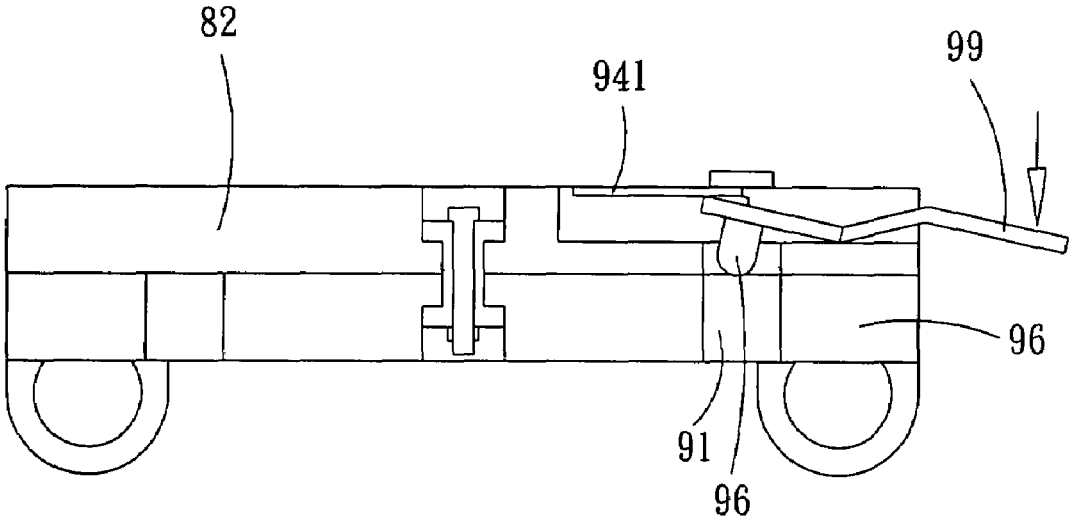

Referring to FIGS. 4A and 4B, in the blocking state, the seat 4 is blocked from turning. When the user presses on the outer end 99 of the lever plate 94, the projection 96 leaves the fixing hole 92, and the seat 4 is freely rotatable. Releasing the outer end 99 of the lever plate 94 in a blocking angular position of the rotatable base 82 allows to assume the blocking state again.

Figure 1:
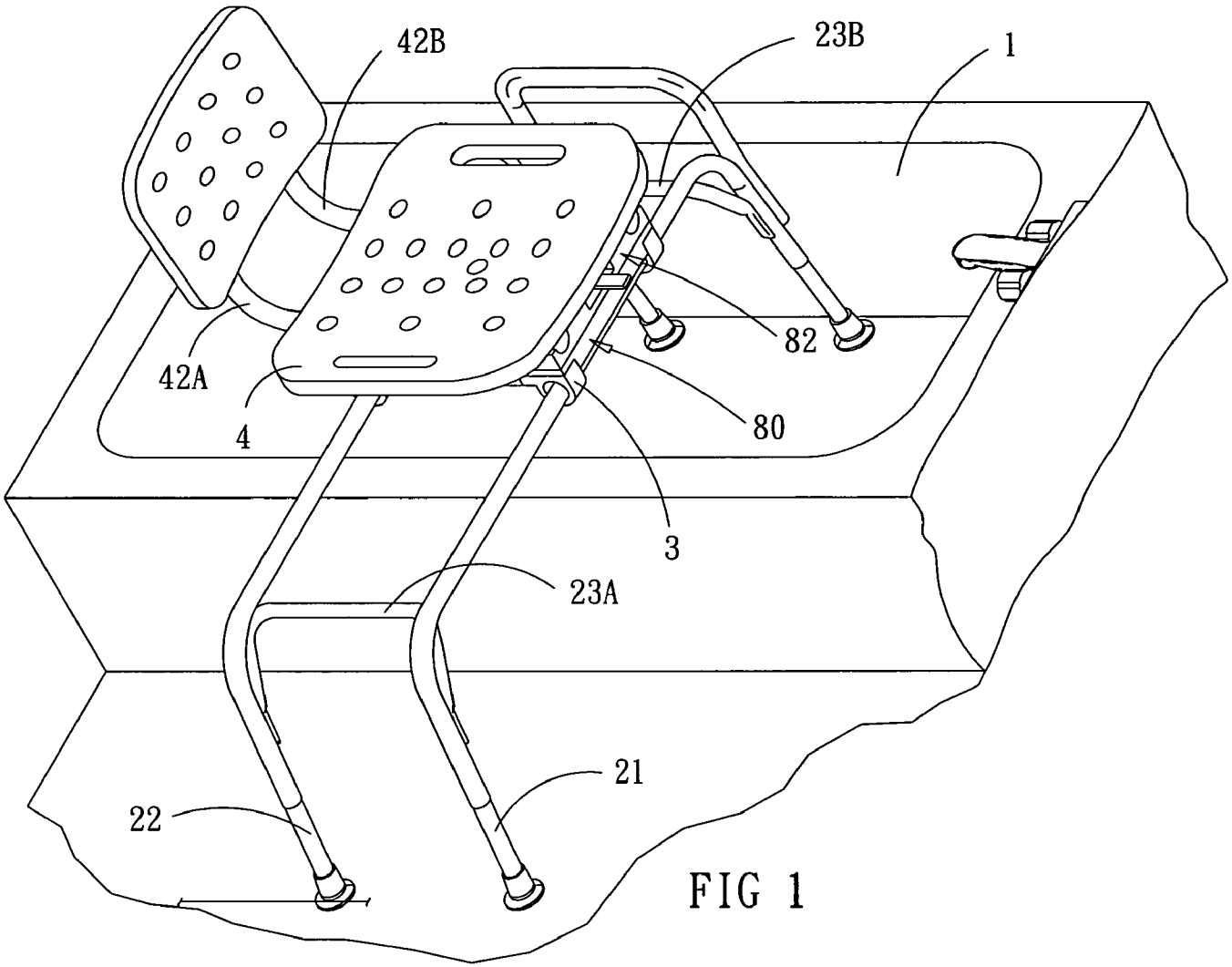
FIG. 1 is a perspective view of the bathing chair of the present invention.
Figure 2:
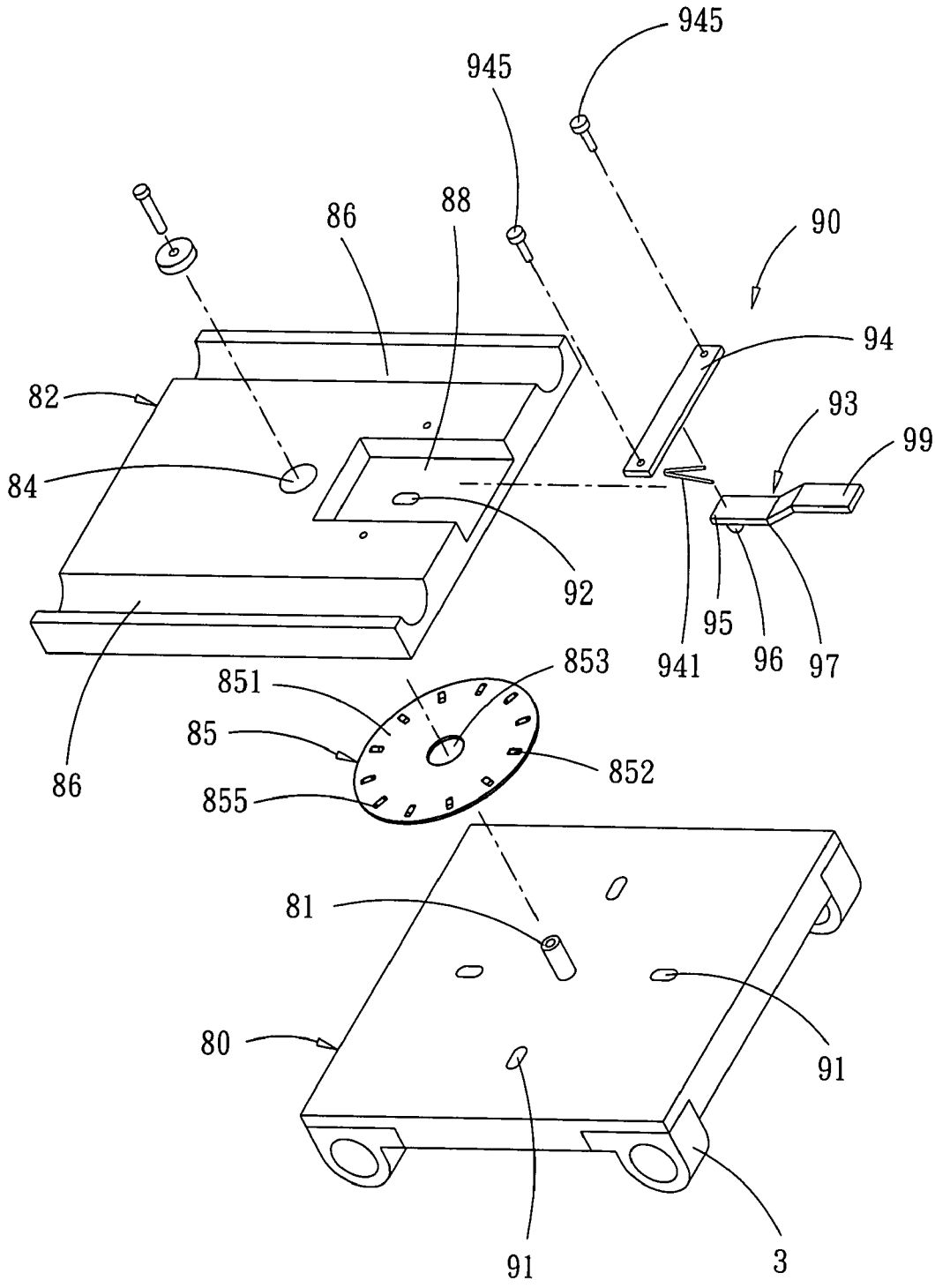
FIG. 2 is an exploded perspective view of the fixed base and the rotatable base of the present invention.
Figure 3:
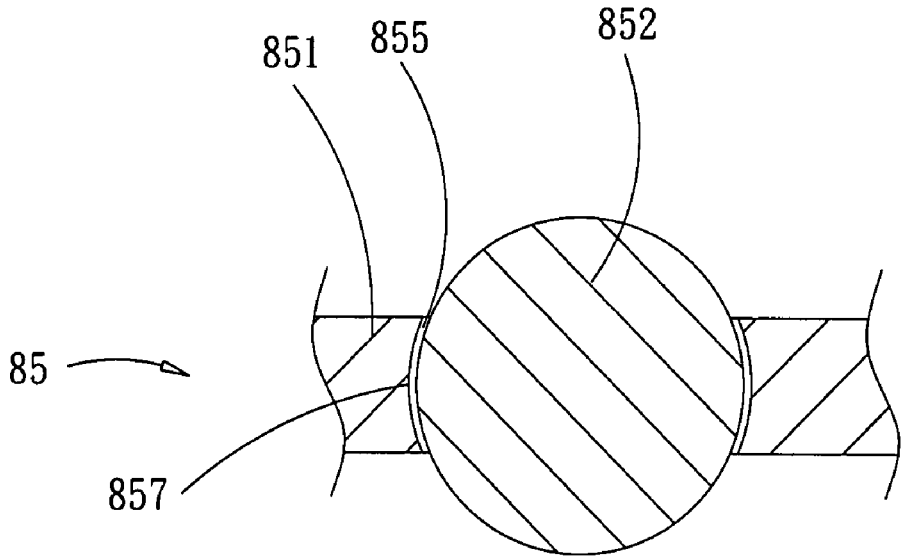
FIG. 3 is a sectional view of the turning device of the present invention.
Figure 5:
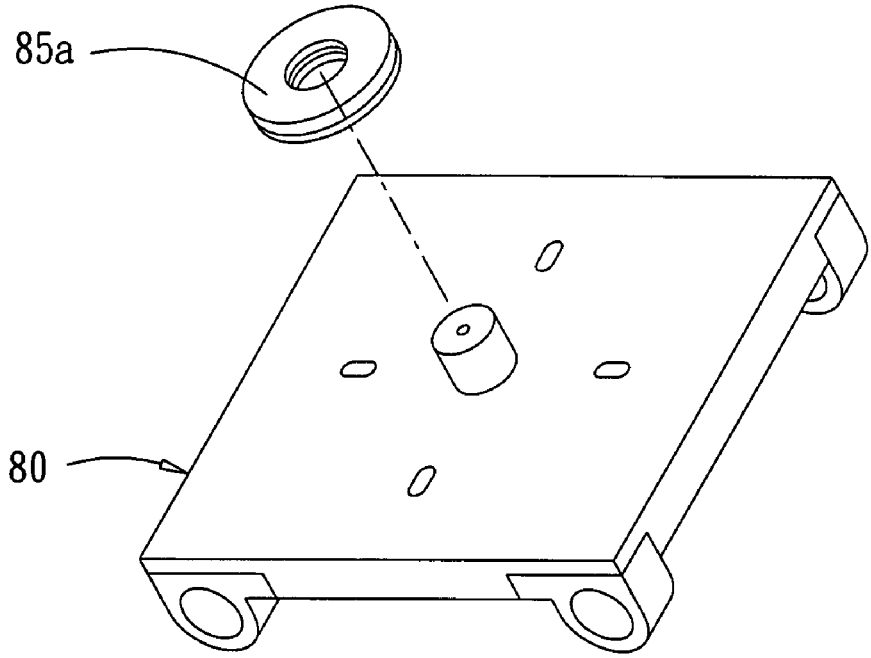
FIG. 5 is a perspective view of the bearing of the present invention in the second embodiment.

Referring to FIG. 5, the present invention in a second embodiment has a conventional bearing 85*a* for reducing friction between the fixed base 80 and the rotatable base 82.

Figure 6:
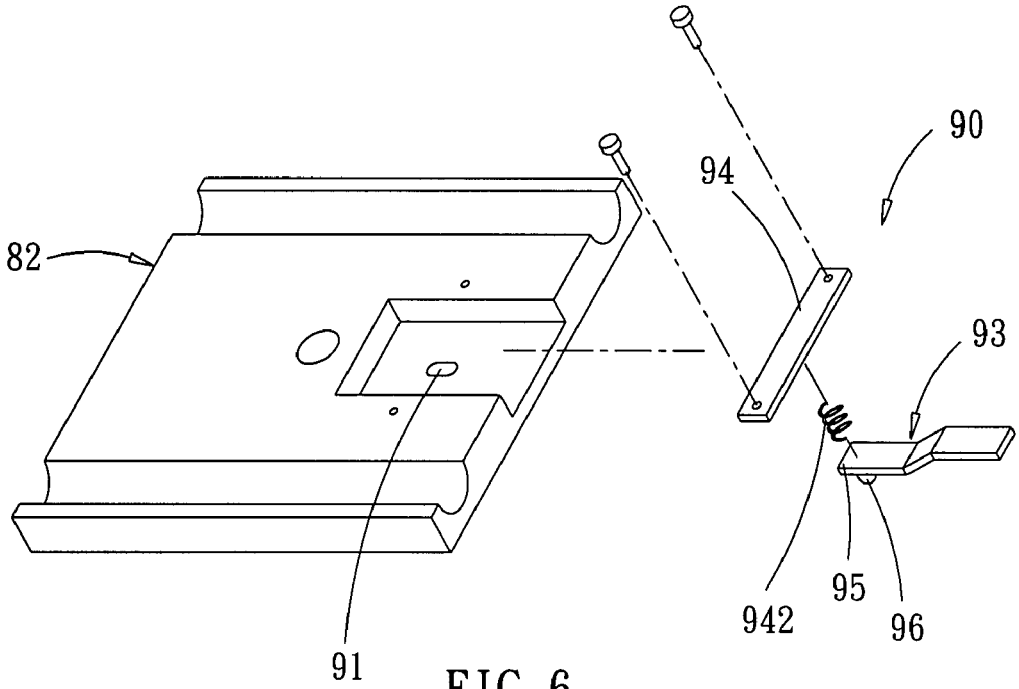
FIG. 6 is a perspective view of the holding device with a helical spring of the present invention in the third embodiment.
Figure 7:
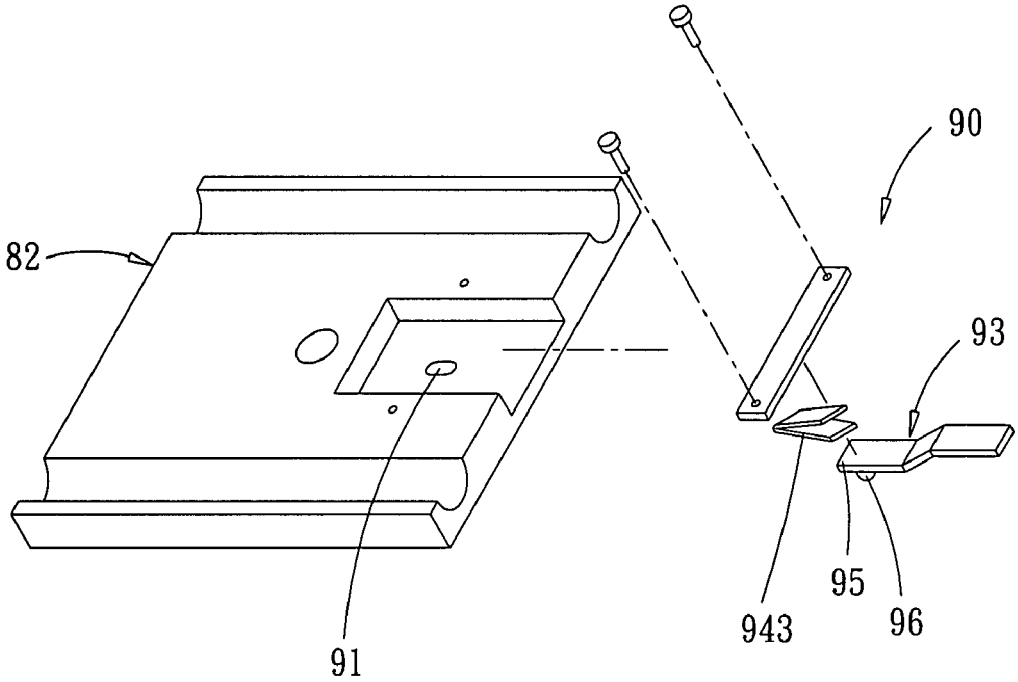
FIG. 7 is a perspective view of the holding device with a plate spring of the present invention in the fourth embodiment.

Referring to FIGS. 6 and 7, the present invention in third and fourth embodiments has a helical spring 942 and a plate spring 943, respectively, inserted between the lever plate 93 and the pressing plate 94, pressing down the holding end 95 of the lever plate 93.

While preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

The invention claimed is:

1. A bathing chair for assisting a user to enter and leave a bathtub, comprising:

a front transverse frame and a rear transverse frame, each of said front and rear transverse frames shaped like inverted letters U, said front and rear transverse frames are parallel to each other and adapted to extend over a width of the bathtub and a longitudinal edge thereof, each of said front and rear transverse frames having a horizontal rod and ends that are placed inside and outside the bathtub, said front and rear transverse frames being connected by right and left connecting rods;

a bearing assembly comprising several gliding blocks connected with a seat on a lower side thereof and allowing said seat to glide along the horizontal rods for a user to enter and to leave the bathtub;

said seat is mounted on said horizontal rods and being movable along said horizontal rods, a backrest connected to said seat by two L-shaped link rods, said link rods constitute an upper seat frame and have horizontal extensions which are fastened to said gliding blocks of said bearing assembly, a plurality of fixing devices fastened to said L-shaped link rods of said seat, said seat further having a fixed base with an upper side, an axis vertically oriented and mounted on said fixed base in a central position thereof, and a rotatable base, wherein said axis is served as a rotational axis for turning said rotatable base on said fixed base, thereby allowing said seat to rotate for easy seating of a user, wherein said rotatable base is set on the upper side of said fixed base and has at a central position thereof a mounting hole, through which said axis passes, and further has two mounting grooves accommodating said L-shaped link rods of said seat, whereby a turning device is mounted on the upper side of said fixed base, said turning device is located between said fixed base and said rotatable base, said turning device having a carrier plate, said carrier plate formed like a disc and having a central hole which is put over said axis, said carrier plate further having several openings with inner walls, in which rolls are inserted for reducing friction, when said turning device rotates on said fixed base, wherein said rotatable base has a depression, accommodating a holding device, said holding device comprises several positioning holes in blocking angular positions on said fixed base, a fixing hole on said rotatable base, a lever plate and a pressing plate, said lever plate has a holding end, with a transverse projection which, in a blocking state, is inserted into said fixing hole, and an outer end, which reaches outward beyond and edge of said rotatable base, whereby said lever plate has a central lever point, around which said holding end and said outer end turn, said pressing plate is mounted on said rotatable base on the upper side thereof by screws, whereby an elastic element is inserted between said lever plate and said pressing plate, pressing down said holding end of said lever plate, so that in the blocking angular positions, when said fixing hole is aligned with one of said positioning holes, the blocking state is assumed, with the projection entering said fixing hole and one of said positioning holes, wherein, in the blocking state, said seat is blocked from turning, whereby when pressure is applied on said outer end of said lever plate, said projection leaves said fixing hole, and said seat is freely rotatable, wherein releasing said outer end of said lever plate in a the blocking angular position of said rotatable base allows to assume the blocking state again; and a handle shaped like the inverted letter U and connected the transverse frames at left ends thereof.

2. The bathing chair with a turnable seat of claim 1, wherein said elastic element is a helical spring.

3. The bathing chair with a turnable seat of claim 1, wherein said elastic element is a plate spring.

* * * * *